United States Patent [19]

Sabella

[11] 4,060,047

[45] Nov. 29, 1977

[54] DEVICE FOR CLEANING BOTTOM OF A BOAT

[76] Inventor: Barney Sabella, 7940 Lankershim Ave., Highland, Calif. 92346

[21] Appl. No.: 717,117

[22] Filed: Aug. 24, 1976

[51] Int. Cl.[2] ..... B63B 39/00; B63B 43/02

[52] U.S. Cl. ..... 114/222; 248/286; 15/144 R

[58] Field of Search ..... 114/222; 15/144 R, 160; 248/286, 285

[56] References Cited

U.S. PATENT DOCUMENTS

| | | | |
|---|---|---|---|
| Re. 12,674 | 7/1907 | Marten | 248/286 |
| 834,399 | 10/1906 | McLellan | 114/222 |
| 1,304,726 | 5/1919 | Bailey | 248/286 |
| 3,010,420 | 11/1961 | Glynn | 114/232 |
| 3,251,331 | 5/1966 | Crawford | 114/222 |
| 3,628,489 | 12/1971 | Michaelsen | 114/222 |

FOREIGN PATENT DOCUMENTS

| | | | |
|---|---|---|---|
| 1,010,286 | 11/1965 | United Kingdom | 15/144 R |

*Primary Examiner*—Trygve M. Blix
*Assistant Examiner*—D. W. Keen
*Attorney, Agent, or Firm*—Allen D. Brufsky

[57] ABSTRACT

A device for cleaning the bottom of a boat or the like while the boat is afloat in the water comprising a pair of rods pivotally connected at corresponding end, a cleaning member pivotally connected to the end of one rod and an adjustable clamp for setting a desired angular position between the rods. Stabilizing members assist in aligning the cleaning member with the surface of the boat.

6 Claims, 5 Drawing Figures

FIG.1
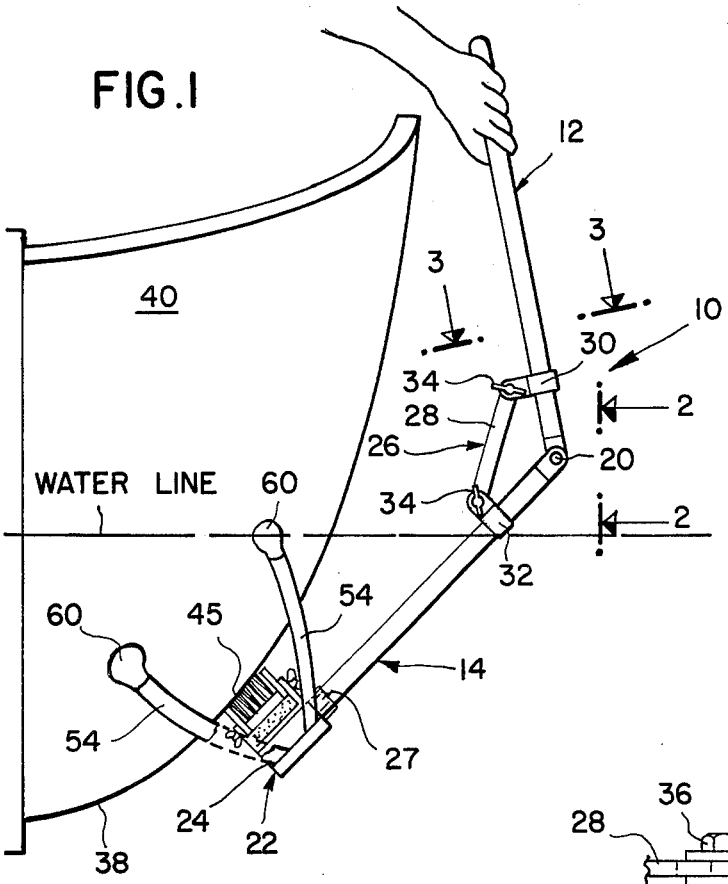
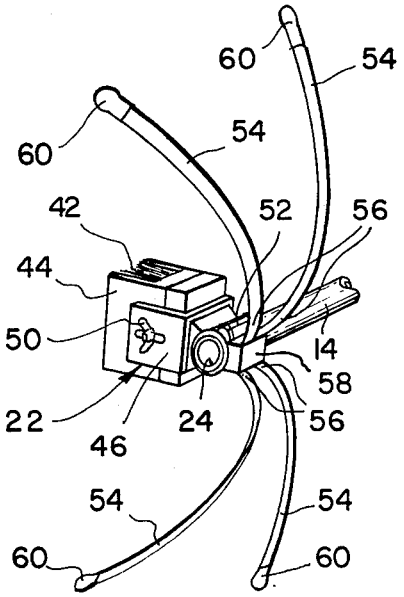
FIG.5
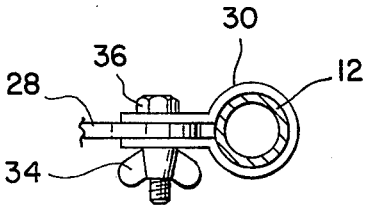
FIG.3
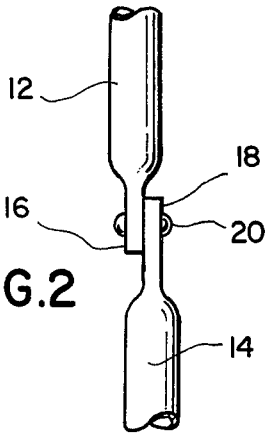
FIG.2
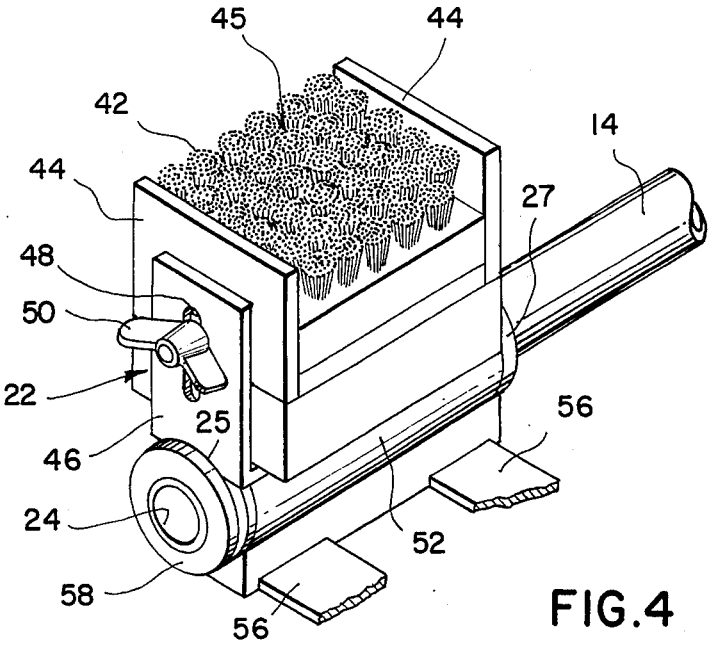
FIG.4

DEVICE FOR CLEANING BOTTOM OF A BOAT

BACKGROUND OF THE INVENTION

The invention relates to devices for cleaning the bottom of boats while the boat is in the water. While the user can stand within the boat.

Several prior art devices for cleaning the bottom of boats require supports external to the boat which must be provided by barges or piers. U.S. Pat. Nos. 637,702, 1,368,692 and 1,466,315 relate to this type of device. Others require guidance by a diver or by a driving and steering means incorporated in the cleaner as disclosed in U.S. pat. Nos. 826,012 and 3,088,429.

U.S. Pat. Nos. 1,471,935, 3,251,331 and 3,707,737 disclose cleaning devices that require that liquid under pressure be forced therethrough to effect cleaning.

None of the aforementioned prior art devices discloses a cheap, simple and purely mechanical device that is alignable to the submerged surface of a boat for scrubbing and scraping sea growths and the like from the boat while the user stands therein.

SUMMARY OF THE INVENTION

It is the principal object of this invention to provide a device for easily cleaning the inwardly curving surface of the hull of a boat while the boat is afloat.

It is a further object of this invention to provide a device that is manually operated from within the boat.

A still further object is to provide means for aligning the cleaning member against the hull.

These and other objects are achieved by the preferred embodiment of the present invention which comprises a cleaning brush and cooperating scraper blades mounted at one end of a pair of pivotally connected rods. The cleaning brush mounting to the rod permits limited rotation thereon to permit alignment with the hull. A brace member is used to set an angle between the rods to match the hull contour and allow reaching the lowermost portions. Finally, stabilizing members comprising spring steel fingers further serve to align the brush.

Having in mind the above and other objects that will be obvious from an understanding of the disclosure, the present invention comprises a combination and arrangement of parts illustrated in the presently preferred embodiments of the invention which are hereinafter set forth in sufficient detail to enable those persons skilled in the art to clearly understand the function, operation, construction and advantages of it when read in conjunction with the accompanying drawings.

BRIEF DESCRIPTION OF THE DRAWING

The invention will be described in detail, by way of example, with reference to the accompanying drawing in which:

FIG. 1 is a pictorial representation of the preferred embodiment utilizing the principles of the present invention;

FIG. 2 is a view of the rod members taken in direction 2—2 in FIG. 1;

FIG. 3 is a sectional view of the rod members taken along line 3—3 in FIG. 1;

FIG. 4 is a pictorial representation of the cleaning means; and

FIG. 5 is a pictorial representation of the stabilizing members and cleaning means.

DETAILED DESCRIPTION OF THE INVENTION

Referring to FIG. 1 of the drawing and in accordance with the principles of the invention, a device for cleaning the bottom of a boat 10 is shown. The device comprises first and second rod members 12 and 14, respectively, connected at first end portions 16 and 18 by a pivot pin 20 as shown in FIG. 2.

Cleaning means 22 is rotatably connected to the second end portion 24 of rod 14 and will be later described in detail. Clamping means 26 which comprises a brace 28 and a pair of clamps 30 and 32 slideable over rods 12 and 14, respectively, are pivotally connected at the ends of brace 28 by means of wing screws 34 and nuts 36 as shown in FIG. 3. The clamps 30 and 32 can be released for sliding or lock in a fixed position by actuation of wing screws 34 cooperating with nuts 36. Thusly, a plurality of angular positions can be formed between the rod members 12 and 14 to enable the positioning the cleaning member 22 against a lower surface 38 of the boat 40 when in use by an operator standing therein. Additional rod members and clamping means, not shown, may be added to lengthen the reach of the device 10.

Referring to FIG. 4, the cleaning means 22 is shown comprising a bristle brush 42 and at least one adjustable scraper blade 44 to form a scrubbing face 45. In the preferred embodiment, two scraper blades 44 are used. The brush is fixed to bracket 46 having slots 48. The scraper blades 44 can be adjusted with respect to the brush 42 in height by means of a pair of thumb nuts 50 engaging threaded studs affixed to the scraper blades 44 and projecting through slots 48. In this way, wear on either the brush 42 or blades 44 can be compensated. The bracket 46 is rotatably mounted to the end 24 of rod 14 with sleeve 52 that is adapted to permit a limited rotation of approximately 180° about the longitudinal axes of the rod 14 thereby allowing sufficient freedom for the scrubbing face 45 to align with the surface 38 of the boat 40. End stop 25 and retaining ring 27 maintain the axial position of the sleeve 52.

A plurality of flexible stabilizing members 54 numbering at least three having a first end 56 are affixed to the back of the cleaning means 22 at support 58 and are cantilevered in a direction toward the scrubbing face 45 and divirge beyond the scrubbing face 45 to a second end. The stabilizing members 54 further assist in aligning the scrubbing face 45 to the boat surface 38 being cleaned by forming, in effect, a large area of contact defined by the second ends of the stabilizing members 54 having the scrubbing face 45 in the approximate center of this area. Being flexible, the stabilizing members 54 will deflect after contacting the boat surface 38 while complying therewith until the scrubbing face 45 contacts this surface 38. The boat 40 can then be brushed and scraped simultaneously by manual movement of the device 10.

The stabilizing members 54 preferably comprise strips of tempered spring steel and have low friction tips 60 made of a plastic material such as teflon.

While preferred and other exemplary embodiments of the invention are illustrated and/or described, it will be understood that the invention is in no way limited to these embodiments.

What is claimed is:

1. A device for cleaning the bottom of a boat while the boat is afloat, the device comprising:

a. a first and second rod member, said first rod member pivotally mounted at a first end portion to a first end portion of said second rod member;

b. cleaning means having a scrubbing face rotatably mounted to a second end portion of said second rod member, said cleaning means rotatable about the longitudinal axis of said second rod member;

c. a plurality of flexible stabilizing members independently disposed about the cleaning means, each of said members having a first portion affixed to said cleaning means and divergent cantilevered second portions extending in the direction of and beyond said scrubbing face and adapted to cooperate with the contour of the boat for further aligning said scrubbing thereof; and d. means for adjustably clamping said first rod member to a desired angular position with respect to said second rod member to enable the positioning of said scrubbing face of said cleaning means against a surface of the bottom of the boat.

2. The device according to claim 1, wherein said cleaning means comprises a bristle brush and a pair of elongated scraper blades adjustably connected to said brush for positioning the blades with respect to said brush, said elongated scraper blades extending substantially the entire width of said brush.

3. The device according to claim 2 wherein said clamping means comprises a brace having first and second releasable clamps disposed at end portions thereof and wherein said clamps are slideable over portions of said first and second rod members respectively when released and maintain a fixed position when clamped for setting the angular position between said rod members.

4. The device according to claim 3, wherein said second portions of said stabilizing means have plastic tips thereon.

5. The device according to claim 4, wherein the stabilizing means includes at least three members fabricated from tempered spring steel.

6. The device according to claidm 5, wherein the clamping means further includes a pair of wing head screws.

* * * * *